US006464394B1

(12) United States Patent
Galomb

(10) Patent No.: US 6,464,394 B1
(45) Date of Patent: Oct. 15, 2002

(54) HANDLE-POUR SPOUT CLOSURE FOR FLEXIBLE PACKAGES, FLEXIBLE PACKAGES INCLUDING THE SAME AND METHOD OF MAKING SUCH FLEXIBLE PACKAGES

(75) Inventor: David E. Galomb, Allentown, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 09/840,512

(22) Filed: Apr. 23, 2001

(51) Int. Cl.[7] ..... B56D 33/16

(52) U.S. Cl. ..... 383/10; 383/69; 383/35; 24/30.5 R

(58) Field of Search ..... 383/10, 69, 906, 383/35, 20; 24/30.5 R, 537

(56) References Cited

U.S. PATENT DOCUMENTS

| | | | | |
|---|---|---|---|---|
| 546,717 A | * | 9/1895 | Shilling, Jr. | 383/69 X |
| 2,951,628 A | * | 9/1960 | Grussen | 383/69 X |
| 4,576,285 A | | 3/1986 | Goglio | |
| 4,705,174 A | | 11/1987 | Goglio | |
| 4,913,561 A | | 4/1990 | Beer | |
| 5,765,264 A | * | 6/1998 | Ciok | 383/906 X |
| 6,139,187 A | | 10/2000 | Galomb et al. | |

* cited by examiner

*Primary Examiner*—Jes F. Pascua
(74) *Attorney, Agent, or Firm*—Caesar, Rivise, Bernstein, Cohen & Pikotilow, Ltd.

(57) ABSTRACT

A flexible package having a handle-pour spout closure including two strip sections and a slidable clamp. The clamp can be slid to one position to hold the sections closed, and to another position to enable them to be pulled apart and opened, and vice versa.

42 Claims, 6 Drawing Sheets

FIG.4
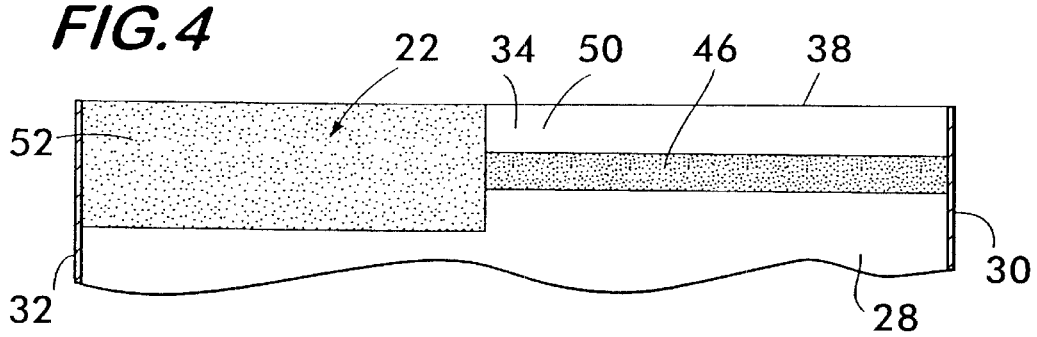
FIG.5
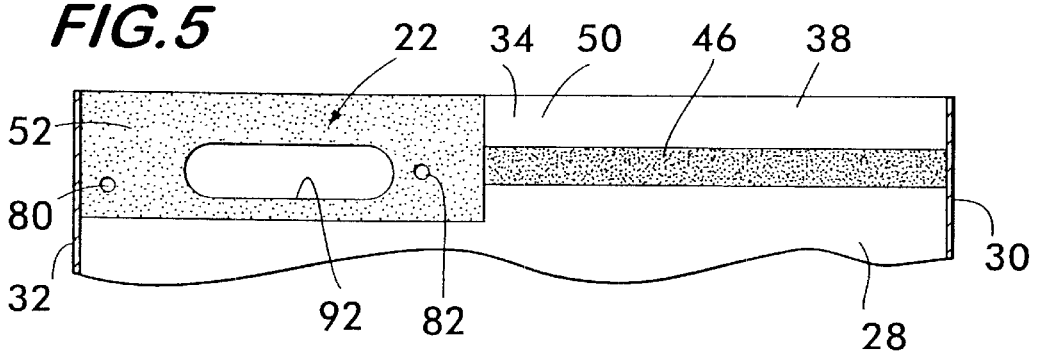
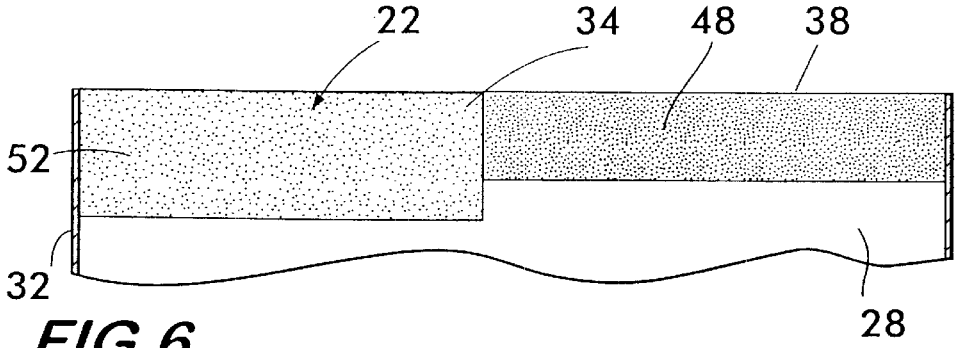
FIG.6
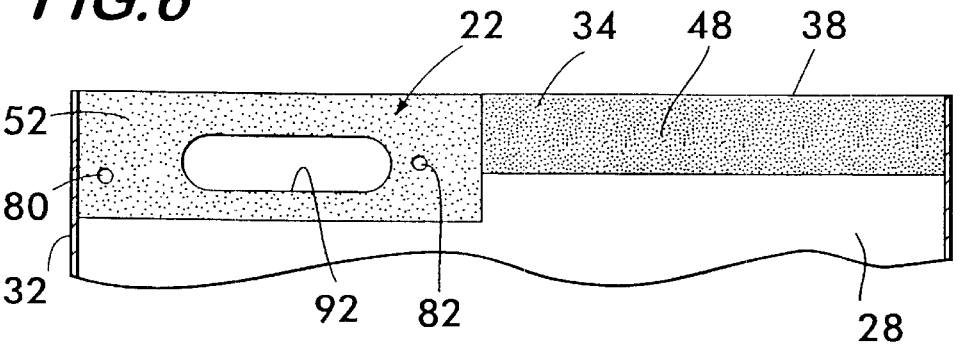
FIG.7

HANDLE-POUR SPOUT CLOSURE FOR FLEXIBLE PACKAGES, FLEXIBLE PACKAGES INCLUDING THE SAME AND METHOD OF MAKING SUCH FLEXIBLE PACKAGES

BACKGROUND OF THE INVENTION

This invention relates generally to flexible packages, and more particularly to handle-pour spout closures for flexible packages holding products therein, and which once opened are arranged to readily pour the contents therefrom via the pour spout, and then to have the pour spout readily re-closed to keep the contents fresh in the package, until the package is again reopened to pour more of the contents therefrom.

Various types of flexible packages for holding particulate materials, e.g., ground or whole bean coffee, chemicals, etc., under vacuum therein have been disclosed in the patent literature and are commercially available today. Examples of such packages are found in the following U.S. Pat. No. 4,576,285 (Goglio), U.S. Pat. No. 4,705,174 (Goglio), and U.S. Pat. No. 4,913,561 (Beer).

The major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of being disposable.

One common type of flexible package for holding goods under vacuum until the package is opened is the so-called "gusseted" package or bag. Typically such a package is formed from a web of flexible stock material, e.g., polyethylene, polyester, polypropylene, metal foil, and combinations thereof in single or multiple plies, into a tubular body, having a face panel, a back panel, and a pair of gusseted sides. Each gusseted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which when opened provides access to the contents of the bag. For example, in one prior art package the top seal is made peelable by modifying the sealant layer with a peelable coating or incompatible additive. Thus, when the seal is peeled apart the unsealed portions form an open mouth through which the contents of the package may be removed. Another approach to providing an opening or mouth for a flexible package is that of the heretofore identified U.S. Pat. No. 4,705,174 (Goglio). That package includes a peel strip applied to the inner surface of the package below the top edges. The strip provides an air-tight interfacial seal which can be readily peeled apart to provide access to the interior of the package. Another approach to providing an opening or mouth for a flexible package is to score the upper flap of the package by laser or mechanical means through a tear initiation resistant layer(s) of the package structure. In this way the package can be opened by tearing away the scored area to form the package's mouth.

In my U.S. Pat. No. 6,139,187 (Galomb et al.) which is assigned to the same assignee as this invention there is disclosed and claimed an interlocking pour-spout closure for a flexible, gusseted package and a flexible gusseted package including such a closure. The package is formed of a flexible material and includes a front panel, a rear panel, and a pair of opposed side gussets. The package is initially sealed, e.g., by a peelable seal line. The panels and gussets each include a top portion. The package also includes a pour-through mouth, e.g., a portion of the panels and one side gusset is arranged to be removed from the remainder of the package. The pour-through mouth is located at the top of the package at one of the side gussets and is arranged to be opened by the pour-spout closure to provide access to the contents of the package. The closure includes a pair of closure sections hingedly secured to each other and each section includes a cut-away portion. Each of the closure sections is arranged to be secured to a respective one of the package's panels, with respective cut-away portions disposed over the at least a portion of the pour-through mouth of the package. The closure sections are arranged to disposed in a confronting releasably secured relationship with each other with portions of the first and second panels and the gussets contiguous with the package's mouth tightly interposed therebetween to close the pour-through mouth, but can be pivoted about the hinge into a non-confronting relationship, whereupon the pour-through mouth is opened so that the material within the package can be poured therethrough.

While the aforementioned prior art devices may suitable for their intended purposes, a need exists for a device for use on flexible packages and/or a flexible package including the same, wherein the device includes a readily openable and reclosable pour spout and a handle for enabling the package to be readily carried and lifted to pour its contents out.

SUMMARY OF THE INVENTION

This invention involves (1) a handle-pour spout closure device for securement to a flexible, e.g., gusseted, package, (2) a flexible package including a handle-pour spout closure device and (3) a method of making such a package. The flexible package has an interior for holding some material, e.g., chemicals, food stuffs, etc., and is formed of a flexible sheet material having first and second panels connected to each other, e.g., by gussets, at respective first and second sides. Each of the panels has a top end including adjacent first and second transversely located portions. The first transversely located portion is located adjacent the first side of the package and has an opening extending through each of the panels thereat. The second transversely located portion is located adjacent the second side of the package. The panels of the package are secured together at the second transversely located portion to form an openable, pour-through mouth thereat.

The handle-pour spout closure device comprises two elongated sections and a slidable clamp member. Each of the sections of the handle closure is secured on the upper end of a respective panel of the package between the first and second sides. Each of the sections includes a first transversely located portion and a second transversely located portion. The first transversely located portion of each of the sections includes an opening arranged to be aligned with the opening in the panel to which the section is mounted. The first transversely located portion of each of the sections are arranged to be fixedly secured to each other with the first transversely located portion of the panels therebetween. The second transversely located portion of each of the sections are arranged to be moved apart from each other to form a pour spout contiguous with the pour-through mouth of the package. Each of the sections also includes a track extending substantially the entire length of the section for sliding receipt of the slidable clamp member. The elongated slidable member is arranged to be slid along the track to the first transversely located portion of the sections to enable the pour spout and mouth of the package to be opened, and also slid along the track to the second transversely located portion of the sections to releasably close the pour spout and the mouth of the package.

DESCRIPTION OF THE DRAWING

FIG. 4 is a front view of the inner surface of the top portion of a gusseted bag showing a permanent seal area and a peelable seal area, as the bag is being fabricated to form the flexible package of FIG. 1;

FIG. 5 is a view similar to FIG. 4, but showing the inner surface of the top portion of a gusseted bag used to make the flexible package of FIG. 1 during the formation of an opening for a handle;

FIG. 6 is a view similar to FIG. 4 but showing an alternative peelable seal area;

FIG. 7 is a view similar to FIG. 5 but showing the embodiment of FIG. 6 during the formation of an opening for a handle;

DETAILED DESCRIPTION OF THE PREFERRED EMBODIMENT

Figure 1:
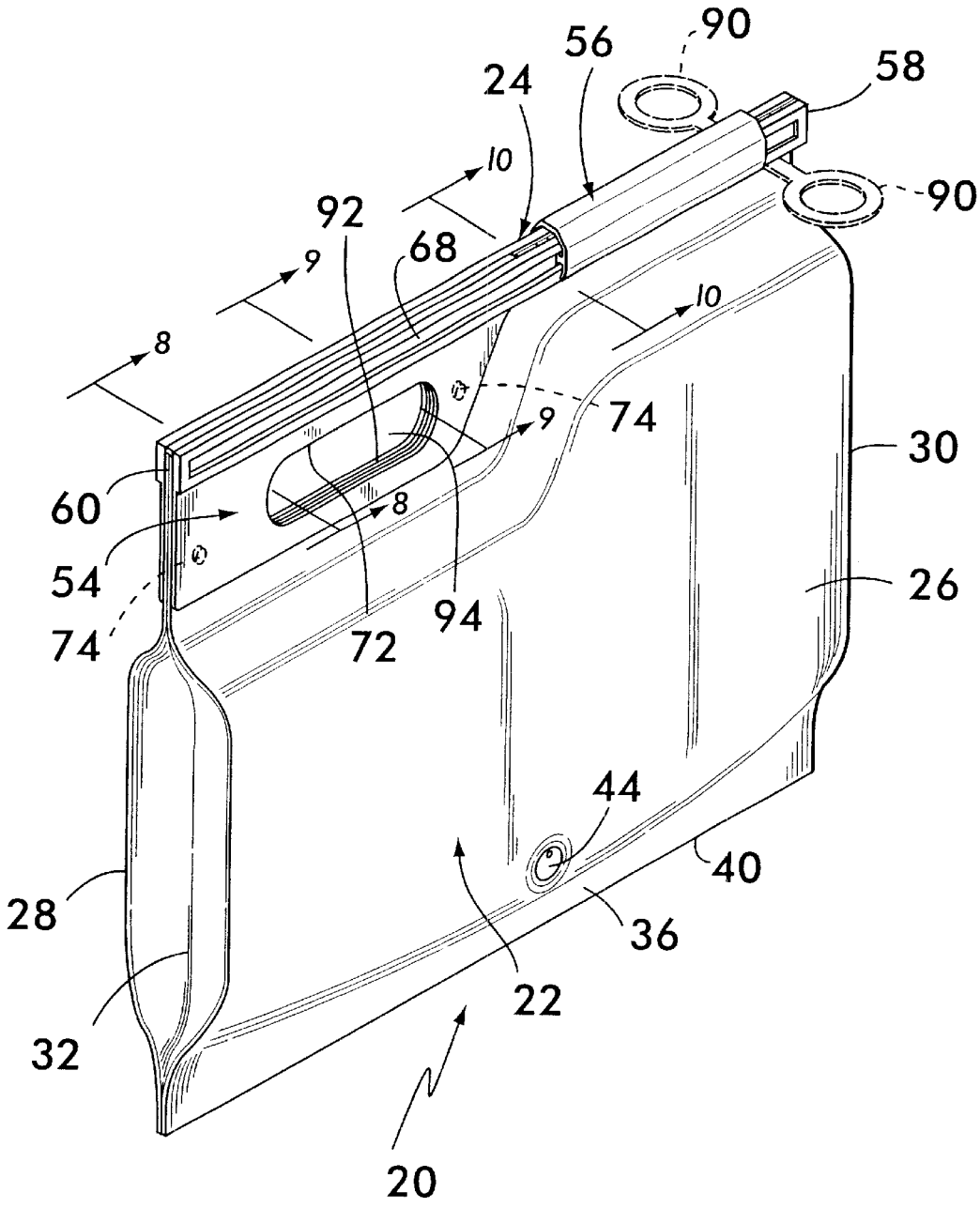
FIG. 1 is an isometric view of one preferred exemplary embodiment of a flexible package constructed in accordance with this invention.

Referring to FIG. 1, there is shown at 20 a flexible package constructed in accordance with this invention. The package 20 basically comprises a gusseted bag 22 and a handle-pour spout closure device 24. The bag 22 is arranged to hold any material, e.g., coffee beans, ground coffee, chemicals, etc., for dispensing, e.g., pouring, therefrom.

The bag 22 is formed of a web of any suitable, flexible material and basically comprises a front wall or panel 26, a rear wall or panel 28, a pair of identical gusseted sides 30 and 32, a top end portion 34 (FIGS. 4–11) and a bottom end portion 36. The top end portion 34 of the package terminates in a top marginal edge 38. In a similar manner the bottom end portion 36 in a bottom marginal edge 40. The package is formed as a tube and includes a longitudinally extending seam or fin (not shown) extending along the back panel 28. The bottom of the package is sealed by one or more conventional heat seal lines (not shown).

An openable pour-through mouth 42 is provided in the top portion of the package contiguous with the side gusset 30. The details of the pour-through mouth will be described later. Suffice it for now to state that the mouth 42 is defined between a transversely located portion of the front panel 26, the rear panel 28 and the interposed side gusset 30 at the top edge 38. Those portions are releasably secured to each other by a peelable seal line or peelable seal area (to be described later with reference to FIGS. 4 and 6). The mouth 42 is arranged to be held closed by the peelable seal line/area and by the handle-pour spout closure 24, as will be described later, to prevent the ingress of air into the package 22 through the mouth until the package is ready to be initially been opened to pour some of the contents therefrom. Once that has been accomplished the handle-pour spout closure device 24 can be operated to reclose the mouth 42 to prevent any of the contents of the package from exiting therethrough and to prevent or at least minimize the ingress of air into the interior of the package through the mouth, thereby maintaining the freshness of the remaining contents of the package.

If desired, a one-way venting valve 44 may be included in any suitable portion of the package to enable gases which may be produced by the material(s), e.g., coffee, contained within the sealed package to vent to the ambient air without air gaining ingress to the package's interior.

The front panel 26, rear panel 28, and the two gusseted sides 30 and 32 of the package are all integral portions of a single sheet or web of the flexible material, of single or multiple ply or layers, which has been folded and seamed along the fin to form a tubular body. The materials forming the package may be plastic, paper, fabric, etc., or combinations of one or more of such materials. One particularly useful flexible material for the package 22 is a laminated web of flexible packaging material commercially available from Fres-Co System USA, Inc., of Telford Pa., the assignee of this invention. That material may include an inner layer in the form of an easy open (peelable) sealant layer to form a peelable seal line/area at the mouth of the bag. That peelable seal can take the form of a narrow a strip or line 46 (FIG. 4) or a wide area 48 (FIG. 6). The narrow strip embodiment of the peelable seal extends across only a portion of the width of the bag, i.e., it encompasses the transverse portion of the bag contiguous with the gusset 30 to approximately the middle of the width of the bag. The narrow peelable seal line 48 is located a short distance, e.g., 20 mm below the top edge of the bag 22 and has a height of approximately 7–14 mm, depending on package construction and size, leaving a finger-grasping area 50 between it and the top edge of the bag (for reasons to be described later) as shown in FIGS. 4 and 5. The wide area peelable seal embodiment 48 also extends across only a portion of the width of the bag, i.e., it encompasses the transverse portion of the bag contiguous with the gusset 30 to approximately the middle of the width of the bag. However, unlike the narrow peelable seal line 46, the wide peelable seal area 48 extends up to the top edge 38 of the bag 22. Irrespective of the height of the peelable seal used, the remaining transverse portion of the bag 22 is permanently sealed, i.e., the top edge portion of the front panel, the top edge portion of the rear panel, and the top edge portion of the gusset 32 are all permanently sealed together at area 52 by any suitable means, e.g., heat sealing, ultrasonic welding, a permanent adhesive, etc. The permanent seal area extends from a point below the lower edge of the peelable seal line/area to the top edge of the bag in the embodiments shown herein. Alternatively, the lower edge of the permanent seal area 50 and the peelable seal line/area 46/48 may be colinear.

It should be pointed out at this juncture that while the package 20 has been shown and described as being in the form of a gusseted bag 22, other types of flexible packages can be used in this invention. Thus, for example, the bag 22 may be of the pouch or pillow type having a front panel and a rear panel connected together by non-gusseted sides, or may be a bottom gusseted bag (e.g., a "stand-up" pouch).

Figure 2:
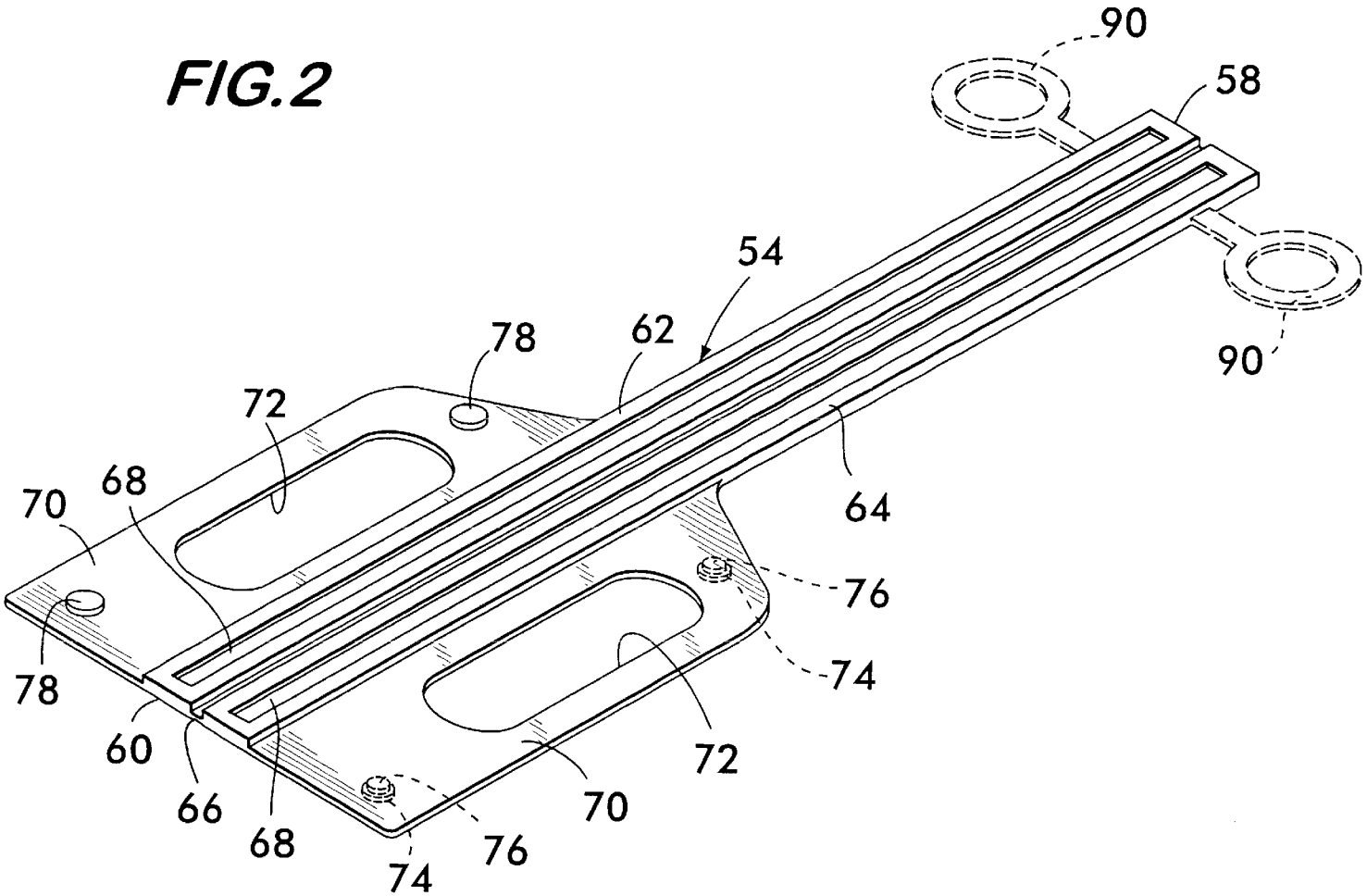
FIG. 2 is an enlarged isometric view of a handle-pour spout closure device used in the package of FIG. 1, but with the device shown in an open or laid-flat condition suitable for mounting on a gusseted bag to make the package of FIG. 1, or for mounting on any other type of flexible package, e.g., a non-gusseted bag.
Figure 3:
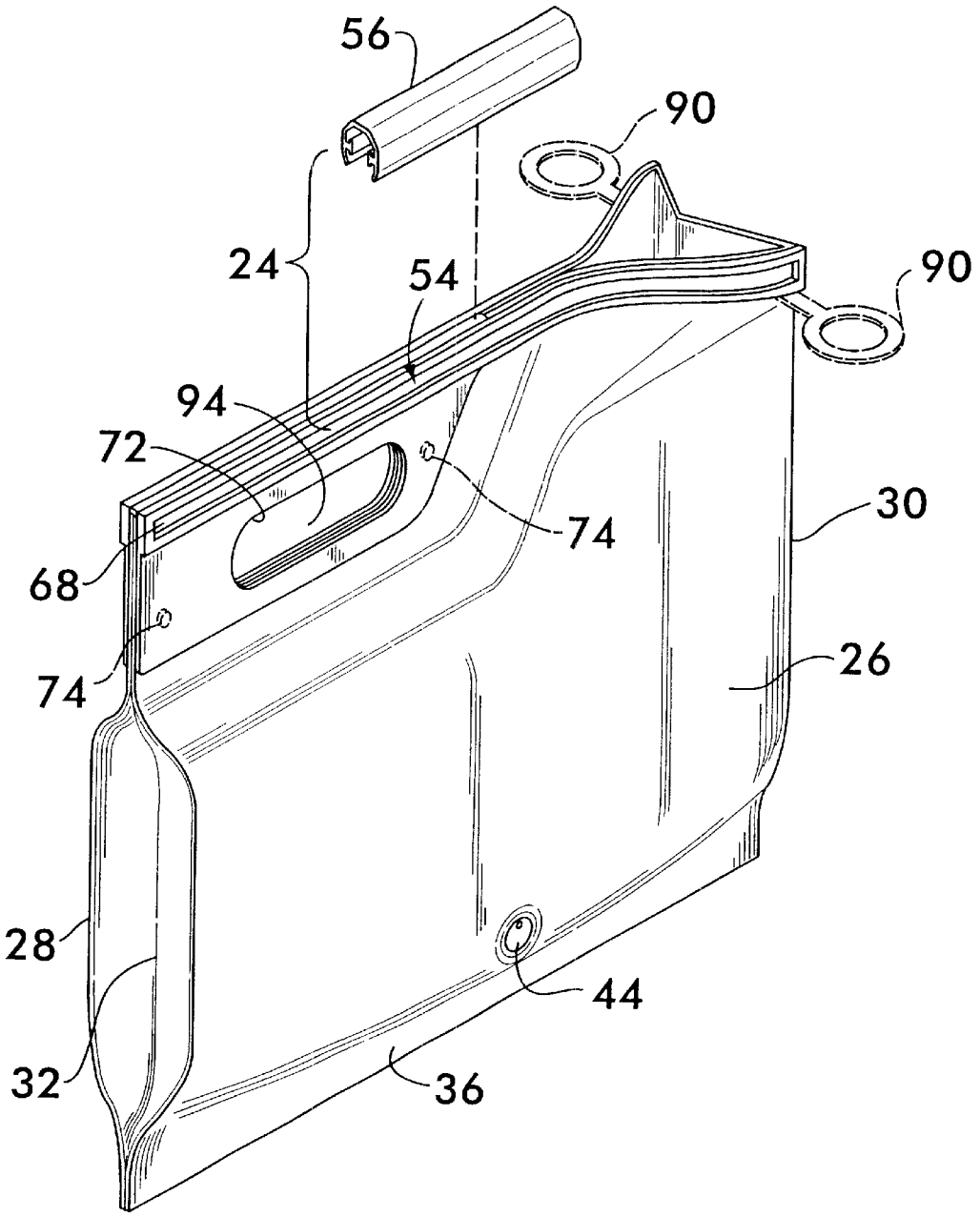
FIG. 3 is an exploded isometric view of the package of FIG. 1 shown in FIG. 1.

In any case, as can be seen clearly in FIGS. 1 and 2, the handle-pour-spout closure device 24 is located on the top end portion 34 of the bag 22. That device is best seen in FIGS. 2 and 3 and basically comprises a closure strip member 54 and a slide clamp member 56. The closure strip member 54 is an elongated member whose width from end 58 to end 60 is equal to the width of the bag 22. The strip member 54 includes two identically shaped, elongated, planar, strip sections 62 and 64 which are interconnected by a hinge 66, e.g., a reduced thickness living hinge. The hinge 66 extends from the end 60 of the member 54 to approximately the middle of the member. The strip sections 62 and 64 are preferably formed from any suitable somewhat stiff material or combination of materials, e.g., high or low density polyethylene or polypropylene, laminated cardboard, etc., to hold their natural planar shape, but which can be flexed or bent somewhat, as will be described later to facilitate the opening of the mouth of the package 20. In a preferred embodiment the closure strip member 54 (i.e., the strip sections 62 and 64 and the interposed living hinge 66) is molded as an integral or one-piece unit.

Each of the strip sections 62 and 64 includes a flat bottomed linear groove or channel 68 extending virtually the entire length of the section between the ends 58 and 60. Each channel is undercut, as can be seen clearly in FIGS. 8–10. The channels 68 are arranged to slidably receive respective portions of the slide clamp 56 to enable the slide clamp to slide along the length of the strip sections 62 and 64 from the "extended" or "closed" position shown in FIG. 1 where the clamp 56 holds the mouth of the package closed, to the "retracted" or "open" position shown in FIG. 11 to enable the mouth of the package to be opened to pour the contents out of the package, and vice versa.

Each of the strip sections 62 and 64 includes a wide ear portion 70 projecting downward therefrom contiguous with the end 60 of the strip member 54. Each ear 70 includes a flat oval opening or hole 72 to form a handle for the device 24. To that end each hole 72 is of a sufficient size to accommodate the fingers of a person. The thickness of the ear portions 70 is less than that of the strip sections 62 and 64 and is of approximately the same thickness as the living hinge 66.

Figure 8:
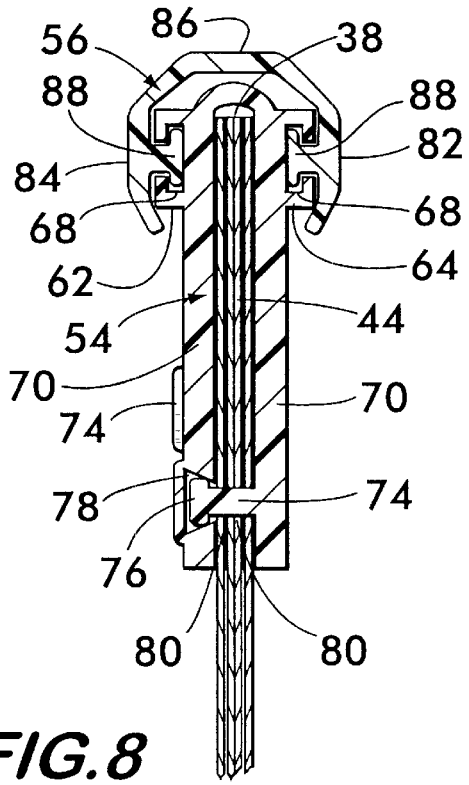
FIG. 8 is an enlarged sectional view taken along line 8—8 of FIG. 1.
Figure 9:
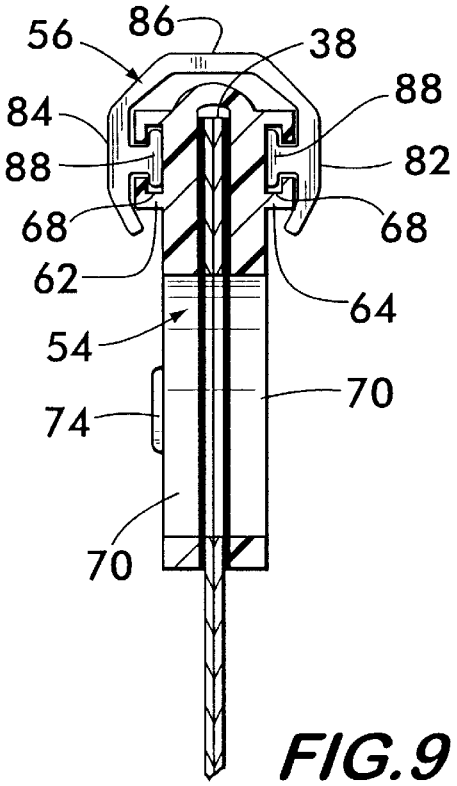
FIG. 9 is an enlarged sectional view taken along line 9—9 of FIG. 1.
Figure 10:
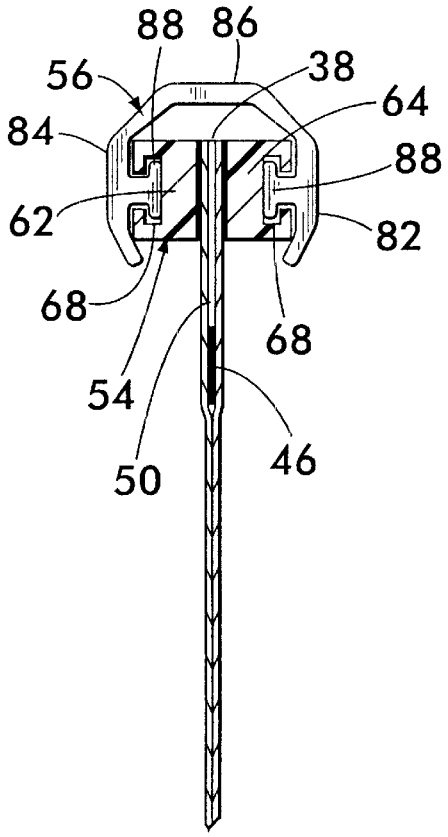
FIG. 10 is an enlarged sectional view taken along line 10—10 of FIG. 1.

The closure strip member 54 is arranged to be fixedly secured to the outer surface of the bag 22 contiguous with the top edge 38 thereof to sandwich the top of the bag between those sections when the strip sections 62 and 64 are in their confronting or closed orientation like that shown in FIG. 1. In particular, each strip section 62 and 64 and its depending ear portion is arranged to be fixedly secured to the outer surface of the top portion of a respective one of the panels 26 and 28 of the package 22 to mount the strip member thereon, so that the ear portions 70 are located contiguous with the gusset 32 and with the elongated strip sections extending the full width of the front and rear panels of the bag so that the top edge of the bag is sandwiched therebetween when those sections are in their confronting or closed orientation as shown in FIGS. 8–10. The securement of the strip member 54 to the bag 22 can be achieved by welding or adhesive securement. For example, if the bag and the strip member are formed of compatible materials the strip member 54 can be secured to the bag by heat sealing. Alternatively, if the bag and the strip member are formed of incompatible materials the strip member can be adhesively secured to the bag.

In either case one or more cooperating connectors (to be described hereinafter) are preferably used to hold the two strip sections in their confronting relationship. To that end the strip member includes two cooperating pairs 74 of connector elements. Each pair of elements comprises a male member, e.g., a post, 76 (FIGS. 2 and 8), and a matingly shaped female member, e.g., a socket or hole, 82 (FIGS. 2 and 8). Thus, as can be seen in FIG. 2 the inner surface of the ear portion 70 depending from strip section 64 includes two posts 78 projecting upward from that surface on opposite sides of the elongated opening 72. The inner surface of the ear portion 70 of the strip-section 62 includes two sockets 78 at similar locations with respect to the elongated opening 72. The posts 78 are arranged to snap-fit into the sockets 78 when the two strip sections 62 and 64 are in their closed, confronting orientation. In order to enable the posts 76 to fit into the sockets 78, the front and rear panels, 26 and 28, respectively, of the bag 22 and the side gusset 32 include aligned holes 80 (FIGS. 5, 7 and 8) for receipt of the outer of the posts 76 therethrough, while the front and rear panels, 26 and 28, respectively, also include aligned holes 82 (FIGS. 5 and 7) for receipt of the inner of the posts 76 to extend therethrough.

At the time that the holes 80 and 82 are formed in the panels/gusset of the bag 22 a pair of elongated holes 92 (FIGS. 5 and 7) are formed in the front and rear panels. These holes are of the same size or slightly larger (to accommodate slight position adjustments of the package's handle) and are aligned with the openings 72 in the portions 70 to form the package's handle 94.

When the strip member 54 is mounted on the bag 22, its two strip sections 62 and 64 are pivoted with respect to each other about the hinge 72 from their open position shown in FIG. 2 into a confronting, closed position shown in FIG. 1, whereupon the two sections tightly hold or sandwich the top portions of the bag 22 between them.

The package 20 is arranged to be initially hermetically sealed along its entire top portion after it has been filled and vacuumized. As mentioned earlier the transverse portion of the bag's upper end contiguous with the gusset 30 is openable, e.g., peelable, along the seal line/area 46/48 and may be formed in any conventional manner. For example, the seal line/area 46/48 may be formed by the appropriate heat sealing of the abutting easy-open sealant layer portions forming the inner surface of the package 22. Alternatively, the peelable seal line/area 46/48 can be formed by the use of peelable sealing strips like that disclosed in the aforementioned Goglio patents, whose disclosures are incorporated by reference herein.

The peelable seal line/area 46/48 extends across the portion, e.g., half, of the width of the package 22 contiguous with the gusset 30. This portion forms the package's mouth. The remaining width of the top of the package is permanently sealed by the seal area 52.

The slide clamp member 56 is best seen in FIGS. 3 and 8–10 and basically comprises a generally U-shaped elongated member having an opposed pair of sidewalls 82 and 84 and an intermediate bridging portion 86. An elongated generally T-shaped member 88 projects inward from each of the sidewalls and includes a flanged free end.

The flanged end of each of the T-shaped members 88 is arranged to be snap-fit within a respective undercut channel 48 in the strip sections 62 and 64 (FIGS. 8–10). The slide clamp 56 is preferably formed of some rigid, yet slightly flexible material, e.g., a plastic, so that the sidewalls and the bridging section can flex to enable the slide clamp to be slidably mounted on the strip sections with the T-shaped members 88 snap-fit within respective ones of the undercut channels 48 in the strip sections.

Figure 11:
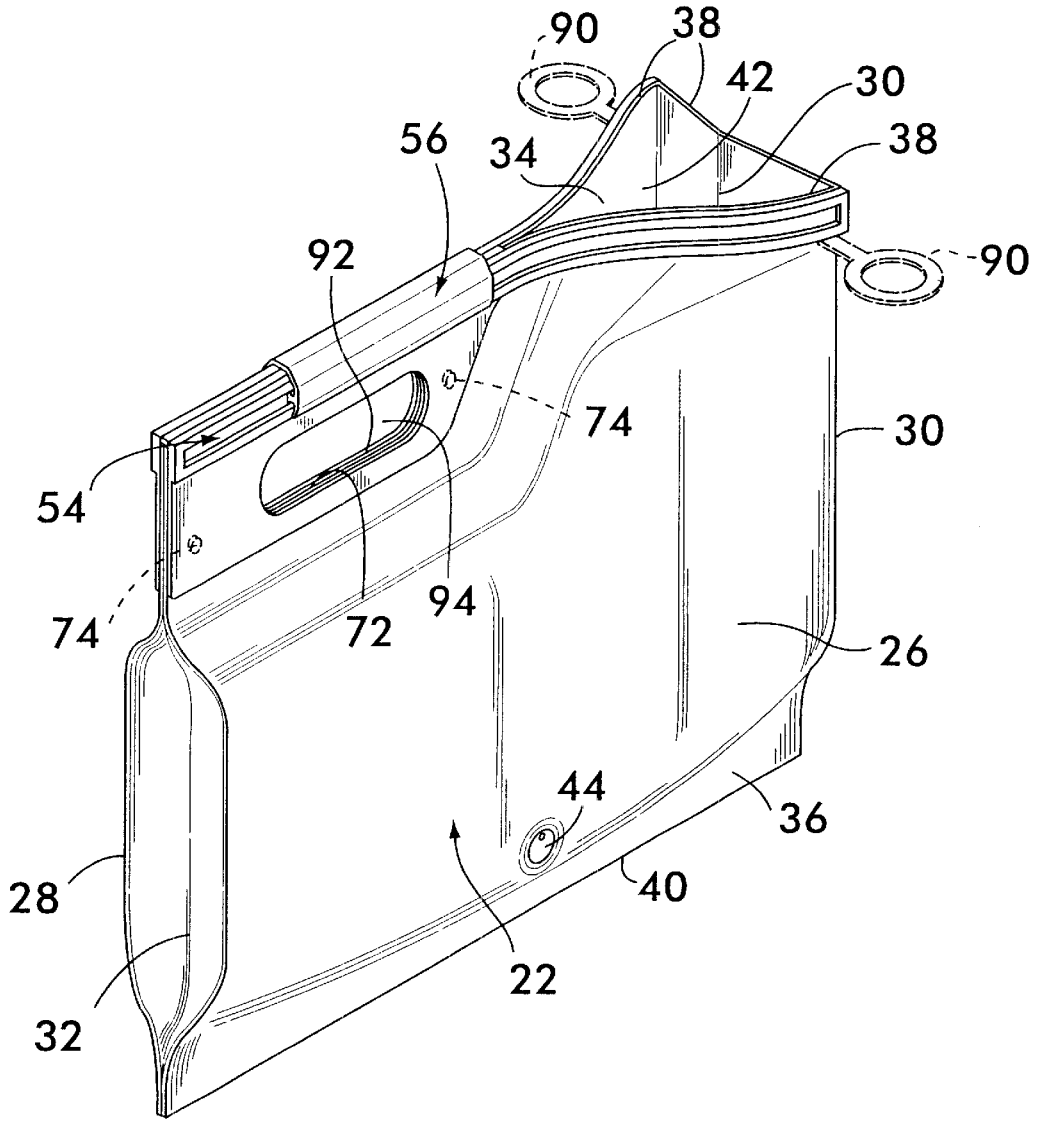
FIG. 11 is an isometric view, similar to FIG. 1, but showing the package with its spout being opened to enable the contents of the package to be poured out of the package.

The mouth of the package 20 is arranged to be readily opened by use of the handle-pour spout closure device 24 so that all or a portion of the contents of the package can be poured therefrom. In particular, the package's mouth can be readily opened by first sliding the slide clamp 56 to its retracted position like that shown in FIG. 11. This action exposes the strip sections 62 and 64 adjacent the gusset 30. Then the user can grasp and pull on the now-exposed top marginal edges of those strip sections (making use of the unsealed portion 50 at the package's mouth) to cause those two sections to separate. To facilitate this action the handle-pour spout closure device 24 may include a pair of pull members. For example, a pair of pull rings 90 (shown by the phantom lines in FIGS. 1–3 and 11) may be provided projecting downward from the bottom edge of the strip sections 62 and 64, respectively, parallel and flush with the plane of the strip section from which they project (see FIG. 2). Each of the pull rings 90 may be formed as an integral unit with the remainder of the handle-pour spout closure device 24 or may be formed separately and attached thereto. In any case, each pull ring is arranged to bent from its flush orientation (FIG. 2) to an orientation wherein it projects generally perpendicularly to the plane of the front and rear panels of the package, such as shown in FIG. 11. In this orientation the user may readily insert his/her finger in the pull ring to pull the associated strip section outward. This action causes the associated strip sections of the handle-pour spout closure device to move from their closed or confronting relationship (FIGS. 1 and 10) to and open albeit confronting relationship (FIGS. 3 and 11) to thereby pull the bag's front and rear panels from engagement with each other and with the interposed gussets at the peelable seal line/area 46/48. This action, when first accomplished, causes the peelable seal line/area 46/48 to open, to thereby open the bag's pour-through mouth and to form the pour spout. Thus, the material within the interior of the package can be readily poured out of the package through the mouth and contiguous spout by merely supporting the package 20 by its handle 94 and then tilting the opened spout of the package downward to enable the contents of the package to pour therefrom.

When it is desired to reclose the package, e.g., when some of the contents have been poured out, leaving some contents within the package, all that is required is to slide the slide clamp 56 down the tracks 68 from its retracted position back to its extended position, i.e., at the end of the tracks contiguous with the side gusset 30. This action has the effect of bringing the two strip sections 62 and 64 adjacent that gusset back into their close confronting relationship with the top portions of the bag interposed tightly therebetween to effectively close the package's mouth. Thus, air is deterred from gaining access to the interior of the package via the package's mouth. When it is desired to reopen the package again, all that is required is to slide the slide clamp 56 back to its retracted position and to pull the portions of the strip sections 62 and 64 contiguous with the gusset 30 apart in the same manner as described above.

As should be appreciated by those skilled in the art, the slider clamp, when in the extended position, provides what can be deemed a "supplemental closure means" to the original peelable seal, and a "retractable physical barrier" that may extend the entire length of the spout area. This reduces the likelihood of product spillage, should the peelable seal become compromised during shipment or handling of the package, a common occurrence with peelable (e.g., easy-open) type seals.

It should be clear from the foregoing that the handle-pour spout closure device 24 may be a separate device and not an integral part of the flexible package. Thus, it is contemplated that the spout closure may be arranged to be mounted or secured on the package after the package has been initially filled, sealed and vacuumized. Moreover, the shape, size and composition of the pour-spout closure device can be modified to accommodate various type of packages. Other types of interlocking members or means can be used in lieu of the interlocking posts and sockets described above. Further still packages constructed in accordance with this invention which have the pour spout closure secured thereto may utilize any type of securement means to fixedly secure them in place on their respective panels. Thus, for example, an adhesive coating or coextrusion may be utilized to secure each strip in place on its associated panel. Alternatively, the material forming the strips or only a portion of the strips may be selected so that it can be heat sealed or welded to the material making up the bag's panels. As will also be appreciated by those skilled in the art, the closures of this invention can be modified insofar as its construction and/or material composition is concerned in order to accommodate the preferred degree of opening and/or closing pressure required to operate it. Thus, it should be clear that the various the embodiments of package shown herein are merely exemplary.

Moreover, the slider clamp of this invention may be so designed as to provide additional strength, stability, support, comfort, etc. to the handle when it is in the retracted position.

Without further elaboration the foregoing will so fully illustrate my invention that others may, by applying current or future knowledge, adopt the same for use under various conditions of service.

I claim:

1. A handle-pour spout closure for securement to a flexible package, the flexible package has a hollow interior and is formed of a flexible material having first and second panels connected to each other at respective first and second sides, each of the panels has a top end portion including a generally planar outer surface and adjacent first and second transversely located portions, the first transversely located portion is located adjacent the first side of the package and has an opening extending through each of the panels thereat, the second transversely located portion is located adjacent the second side of the package, the panels of the package are secured together at the second transversely located portion to form an openable pour-through mouth thereat, said closure comprises two elongated sections and a slidable member, each of said sections of said closure being arranged to be secured on the top end portion of a respective panel of the package between the first and second sides, each of said sections including a first transversely located portion and a second transversely located portion, said first transversely located portion of each of said sections including an opening arranged to be aligned with the opening in the panel of the package to which said section is secured, said first transversely located portion of each of said sections being arranged to be fixedly secured to each other with the first transversely located portion of the panels therebetween, said second transversely located portion of each of said sections being arranged to be moved apart from each other to form a pour spout contiguous with the pour-through mouth of the package, each of said sections also including a track extending substantially the entire length thereof, said track including at least one guide surface extending along at least a portion of said track, said guide surface being spaced from the planar outer surface of the top end portion of its associated panel for sliding receipt of said slidable member, said slidable member being arranged to be slid along said track to said first transversely located portion of said sections to enable said pour spout and the mouth of the package to be opened, and also slid along said track to said second transversely located portion of said sections to releasably close said pour spout and the mouth of the package, said at least one guide surface of said track being arranged guide said slidable member along said track.

2. The handle-spout closure of claim 1 wherein said slidable member is channel shaped.

3. The handle-spout closure of claim 1 wherein each of said sections of said closure is arranged to be fixedly secured on the upper end of a respective panel of the package between the first and second sides.

4. The handle-spout closure of claim 3 wherein said fixed securement of each of said sections on the upper end of a respective panel is effected by a heat seal.

5. The handle-spout closure of claim 3 wherein said fixed securement of each of said sections on the upper end of a respective panel is effected by an adhesive.

6. The handle-spout closure of claim 1 wherein said closure is formed of a plastic material.

7. A handle-pour spout closure for securement to a flexible package, the flexible package has a hollow interior and is formed of a flexible material having first and second panels connected to each other at respective first and second sides, each of the panels has a top end including adjacent first and second transversely located portions, the first transversely located portion is located adjacent the first side of the package and has an opening extending through each of the panels thereat, the second transversely located portion is located adjacent the second side of the package, the panels of the package are secured together at the second transversely located portion to form an openable pour-through mouth thereat, said closure comprises two elongated sections and a slidable member, each of said sections of said closure being arranged to be secured on the upper end of a respective panel of the package between the first and second sides, each of said sections including a first transversely located portion and a second transversely located portion, said first transversely located portion of each of said sections including an opening arranged to be aligned with the opening in the panel of the package to which said section is secured, said first transversely located portion of each of said sections being arranged to be fixedly secured to each other with the first transversely located portion of the panels therebetween, said second transversely located portion of each of said sections being arranged to be moved apart from each other to form a pour spout contiguous with the pour-through mouth of the package, each of said sections also including a track extending substantially the entire length thereof for sliding receipt of said slidable member, said slidable member being arranged to be slid along said track to said first transversely located portion of said sections to enable said pour spout and the mouth of the package to be opened, and also slid along said track to said second transversely located portion of said sections to releasably close said pour spout and the mouth of the package, said handle-spout closure additionally comprising at least one snap connector for effecting the fixed securement of a first transversely located portion of each of said sections to each other with the first transversely located portion of the panels therebetween.

8. The handle-spout closure of claim 7 additionally comprising at least one opening in said panels through which at least one portions of said at least one snap connector extends to fixedly secure said first transversely located portion of each of said sections to each other with the first transversely located portion of the panels therebetween.

9. The handle-spout closure of claim 8 wherein said sections are hingedly secured to each other at said first transversely located portion.

10. The handle-spout closure of claim 7 wherein said sections are hingedly secured to each other at said first transversely located portion.

11. A handle-pour spout closure for securement to a flexible package, the flexible package has a hollow interior and is formed of a flexible material having first and second panels connected to each other at respective first and second sides, each of the panels has a top end including adjacent first and second transversely located portions, the first transversely located portion is located adjacent the first side of the package and has an opening extending through each of the panels thereat, the second transversely located portion is located adjacent the second side of the package, the panels of the package are secured together at the second transversely located portion to form an openable pour-through mouth thereat, said closure comprises two elongated sections and a slidable member, each of said sections of said closure being arranged to be secured on the upper end of a respective panel of the package between the first and second sides, each of said sections including a first transversely located portion and a second transversely located portion, said first transversely located portion of each of said sections including an opening arranged to be aligned with the opening in the panel of the package to which said section is secured, said first transversely located portion of each of said sections being arranged to be fixedly secured to each other with the first transversely located portion of the panels therebetween, said second transversely located portion of each of said sections being arranged to be moved apart from each other to form a pour spout contiguous with the pour-through mouth of the package, each of said sections also including a track extending substantially the entire length thereof for sliding receipt of said slidable member, said slidable member being arranged to be slid along said track to said first transversely located portion of said sections to enable said pour spout and the mouth of the package to be opened, and also slid along said track to said second transversely located portion of said sections to releasably close said pour spout and the mouth of the package, said handle-spout closure additionally comprising respective stops on each of said sections at the sides of the package to prevent said slidable member from sliding out of said track.

12. A handle-pour spout closure for securement to a flexible package, the flexible package has a hollow interior and is formed of a flexible material having first and second panels connected to each other at respective first and second sides, each of the panels has a top end including adjacent first and second transversely located portions, the first transversely located portion is located adjacent the first side of the package and has an opening extending through each of the panels thereat, the second transversely located portion is located adjacent the second side of the package, the panels of the package are secured together at the second transversely located portion to form an openable pour-through mouth thereat, said closure comprises two elongated sections and a slidable member, each of said sections of said closure being arranged to be secured on the upper end of a respective panel of the package between the first and second sides, each of said sections including a first transversely located portion and a second transversely located portion, said first transversely located portion of each of said sections including an opening arranged to be aligned with the opening in the panel of the package to which said section is secured, said first transversely located portion of each of said sections being arranged to be fixedly secured to each other with the first transversely located portion of the panels therebetween, said second transversely located portion of each of said sections being arranged to be moved apart from each other to form a pour spout contiguous with the pour-through mouth of the package, each of said sections also including a track extending substantially the entire length thereof for sliding receipt of said slidable member, said slidable member being arranged to be slid along said track to said first transversely located portion of said sections to enable said pour spout and the mouth of the package to be opened, and also slid along said track to said second transversely located portion of said sections to releasably close said pour spout and the mouth of the package, said handle-spout closure additionally comprising a pair of pull tabs located on each of said second transversely located portions of said sections.

13. The handle-spout closure of claim 12 wherein each of said tabs is in the form of a ring.

14. In combination a flexible package and a handle-pour spout closure, said flexible package having a hollow interior and being formed of a flexible material having first and second panels connected to each other at respective first and second sides, each of said panels having a top end portion including a generally planar outer surface and adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said top end portion of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof, said track including at least one guide surface extending along at least a portion of said track, said guide surface being spaced from the planar outer surface of the top end portion of its associated panel for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably close said pour spout and said mouth of said package, said at least one guide surface of said track being arranged to guide said slidable member along said track.

15. The combination of claim 14 wherein said slidable member is channel shaped.

16. The combination of claim 14 wherein each of said sections of said closure is arranged to be fixedly secured on said upper end of a respective panel of said package between said first and second sides.

17. The combination of claim 16 wherein said fixed securement of each of said sections on said upper end of a respective panel is effected by a heat seal.

18. The combination of claim 16 wherein said fixed securement of each of said sections on said upper end of a respective panel is effected by an adhesive.

19. In combination a flexible package and a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said upper end of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably close said pour spout and said mouth of said package, said combination additionally comprising at least one snap connector for effecting said fixed securement of a first transversely located portion of each of said sections to each other with said first transversely located portion of said panels therebetween.

20. The combination of claim 19 additionally comprising at least one opening in said panels through which at least one portions of said at least one snap connector extends to fixedly secure said first transversely located portion of each of said sections to each other with said first transversely located portion of said panels therebetween.

21. The combination of claim 20 wherein said sections are hingedly secured to each other at said first transversely located portion.

22. The combination of claim 19 wherein said sections are hingedly secured to each other at said first transversely located portion.

23. In combination a flexible package and a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said upper end of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably close said pour spout and said mouth of said package, said combination additionally comprising respective stops on each of said sections at said sides of said package to prevent said slidable member from sliding out of said track.

24. In combination a flexible package and a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said upper end of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably close said pour spout and said mouth of said package, each of said first and second sides being gusseted.

25. The combination of claim 24 additionally comprising a pair of pull tab located on each of said second transversely located portions of said sections.

26. The combination of claim 25 wherein each of said tabs is in the form of a ring.

27. The combination of claim 24 wherein said closure is formed of a plastic material.

28. In combination a flexible package and a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said upper end of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably close said pour spout and said mouth of said package, said combination additionally comprising a pair of pull tabs located on each of said second transversely located portions of said sections.

29. The combination of claim 28 wherein each of said tabs is in the form of a ring.

30. In combination a flexible package and a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections of said closure being arranged to be secured on said upper end of a respective panel of said package between said first and second sides, each of said sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof for sliding receipt of said elongated slidable member, said elongated slidable member being arranged to be slid along said track to said first transversely located portion of said sections to enable said pour spout and said mouth of said package to be opened, and also slid along said track to said second transversely located portion of said sections to releasably dose said pour spout and said mouth of said package, said closure being formed of a plastic material.

31. A flexible package having a handle-pour spout closure, said flexible package comprising two elongated sections, an elongated slidable pane and first and second flexible material panels connected to each other at respective first and second sides to form a hollow interior for the package, each of said panels having a top end portion including a generally planar outer surface and adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, each of said elongated sections being secured at said upper end of a respective panel of said package between said first and second sides, each of said elongated sections including a first transversely located portion and a second transversely located portion, said first transversely located portion of each of said sections including an opening arranged to be aligned with said opening in said panel of said package to which said section is secured, said first transversely located portion of each of said sections being arranged to be fixedly secured to each other with said first transversely located portion of said panels therebetween, said second transversely located portion of each of said sections being arranged to be moved apart from each other to form a pour spout contiguous with said pour-through mouth of said package, each of said sections also including a track extending substantially said entire length thereof, said track including at least one guide surface extending along at least a portion of said track, said guide surface being spaced from the planar outer surface of the top end portion of its associated panel, said elongated slidable member being slidingly received by said track to be slid along said track to said first transversely located portion of said sections to enable said pour spout and said mouth of said package to be opened, and also slid along said track to said second transversely located portion of said sections to releasably close said pour spout and said mouth of said package, with said at least one guide surface of said track guiding said slidable member along said track.

32. A method of making flexible package having a handle-pour spout closure, said flexible package having a hollow interior and being formed of a flexible material having first and second panels connected to each other at respective first and second sides, each of said panels having a top end portion including a generally planar outer surface and adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections including a first transversely located portion and a second transversely located portion, said first transversely located portion of each of said sections including an opening, each of said sections also including a track extending substantially said entire length thereof, said track including at least one guide surface extending along at least a portion of said track, said guide surface being spaced from the planar outer surface of the top end portion of its associated panel for sliding receipt of said elongated slidable member:

(A) securing each of said sections of said closure on said upper end of a respective panel of said package between said first and second sides, with said opening in each of said sections being aligned with the opening in said panel of said package to which each of said sections is secured and with said second transversely located portion of each of said sections being contiguous with said mouth of said package and arranged to be moved apart from each other to form a pour spout at said mouth of said package; and (B) fixedly securing said first transversely located portion of each of said sections to each other with said first transversely located portion of said panels therebetween; and (C) providing said slidable member in said track, whereupon said slidable member is arranged to be slid along said track to said first transversely located portion of said sections to enable said pour spout and said mouth of said package to be opened, and also slid along said track to said second transversely located portion of said sections to releasably close said pour spout and said mouth of said package with said at least one guide surface of said track guiding said slidable member along said track.

33. The method of claim 32 wherein said sections are hingedly secured together.

34. The method of claim 32 additionally comprising filling said package with some material and then sealing said mouth of said package closed.

35. The method of claim 34 wherein said seal is a releasably securable seal.

36. The method of claim 35 additionally comprising fixedly sealing said panels together at said first transversely located portion.

37. The method of claim 34 additionally comprising cutting respective aligned holes in said panels at said first transversely located portion of said package.

38. The method of claim 32 wherein said fixed securement of said sections to said panels is achieved by means of an adhesive.

39. The method of claim 32 wherein said fixed securement of said sections to said panels is achieved by means of a thermal bond.

40. A method of making flexible package having a handle-pour spout closure, said flexible package having a hollow interior and being formed of a flexible material having first and second panels connected to each other at respective first and second sides, each of said panels having a top end including adjacent first and second transversely located portions, said first transversely located portion being located adjacent said first side of said package and having an opening extending through each of said panels thereat, said second transversely located portion being located adjacent said second side of said package, said panels of said package being secured together at said second transversely located portion to form an openable pour-through mouth thereat, said closure comprising two elongated sections and an elongated slidable member, each of said sections including a first transversely located portion and a second transversely located portion, said first transversely located portion of each of said sections including an opening, each of said sections also including a track extending substantially said entire length thereof for sliding receipt of said elongated slidable member:

(A) securing each of said sections of said closure on said upper end of a respective panel of said package between said first and second sides, with said opening in each of said sections being aligned with the opening in said panel of said package to which each of said sections is secured and with said second transversely located portion of each of said sections being contiguous with said mouth of said package and arranged to be moved apart from each other to form a pour spout at said mouth of said package;

(B) fixedly securing said first transversely located portion of each of said sections to each other with said first transversely located portion of said panels therebetween, said fixed securement of said first transversely located portion of each of said sections to each other with said first transversely located portion of said panels therebetween is achieved by providing at least one snap connector for said sections; and (C) providing said slidable member in said track, whereupon said slidable member is arranged to be slid along said track to said first transversely located portion of said sections to enable said pour spout and said mouth of said package to be opened, and also slid along said track to said second transversely located portion of said sections to releasably close said pour spout and said mouth of said package.

41. The method of claim 40 additionally comprising providing at least one opening in said panels through which a portion of said at least one snap connector is extended.

42. The method of claim 41 additionally comprising ultrasonically welding said at least one snap connector.

* * * * *